US005728984A

United States Patent [19]

Miller

[11] Patent Number: 5,728,984

[45] Date of Patent: Mar. 17, 1998

[54] SENSING SAFETY EDGE SYSTEMS

[75] Inventor: Bearge D. Miller, West Grove, Pa.

[73] Assignee: Miller Edge, Inc., Concordville, Pa.

[21] Appl. No.: 754,769

[22] Filed: Nov. 20, 1996

[51] Int. Cl.[6] ..... H01H 3/16

[52] U.S. Cl. ..... 200/61.43; 200/837; 200/85 R; 200/61.73; 49/26; 49/28

[58] Field of Search ..... 200/61.42–61.44, 200/61.62, 61.7, 61.71–61.76, 61.81, 837, 814, 83 R, 81 R, 81.8, 85 R, 86 R, 275; 49/25–29

[56] References Cited

U.S. PATENT DOCUMENTS

| | | | |
|---|---|---|---|
| 3,260,812 | 7/1966 | Miller | 200/61.43 |
| 3,303,303 | 2/1967 | Miller | 200/61.43 |
| 3,417,215 | 12/1968 | Corona et al. | 200/86 |
| 3,530,925 | 9/1970 | Miller | 160/180 |
| 3,986,577 | 10/1976 | Ebbesson et al. | 180/92 |
| 4,349,710 | 9/1982 | Miller | 200/61.43 |
| 4,396,814 | 8/1983 | Miller | 200/61.43 |
| 4,620,072 | 10/1986 | Miller | 200/81 R |
| 4,785,143 | 11/1988 | Miller | 200/61.43 |
| 4,908,483 | 3/1990 | Miller | 200/61.43 |
| 4,944,116 | 7/1990 | Mewald | 49/27 |
| 4,972,054 | 11/1990 | Miller et al. | 200/61.43 |
| 5,023,411 | 6/1991 | Miller et al. | 200/61.43 |
| 5,027,552 | 7/1991 | Miller et al. | 49/27 |
| 5,124,511 | 6/1992 | Miller et al. | 200/61.43 |
| 5,203,110 | 4/1993 | Hormann | 49/28 |
| 5,259,143 | 11/1993 | Mitchell et al. | 49/27 |
| 5,481,076 | 1/1996 | Mullett et al. | 200/61.43 |

*Primary Examiner*—Cassandra C. Spyrou
*Assistant Examiner*—Michael A. Friedhofer
*Attorney, Agent, or Firm*—Panitch Schwarze Jacobs & Nadel, P.C.

[57] ABSTRACT

Each sensing safety edge system includes an elongated, one-piece, flexibly resilient, extrusion of air-impervious material. The extrusion includes an elongated hollow member with tubular wall, a pair of laterally spaced apart support legs extending radially outwardly from an outer side of the tubular wall, an elongated mounting strip extending outwardly from the tubular wall between the pair of support legs and a weather strip extending outwardly from an opposing side of the tubular member. Conical plug closures are provided in each of two opposing ends of the tubular member, preferably so as to seal the ends to air passage. The resulting safety edge is mounted on a leading edge of an overhead steel door or like movable structure. In different embodiments, a pneumatic switch, which may be an air wave responsive switch with diaphragm and adjustable bleed valve, is located outside the tubular member and is coupled with the hollow interior of the tubular member by a separate tube, which may be passed through one of the closures or transversely through the tubular wall of the extrusion. Alternatively, the tubular member may receive a pair of spaced apart opposing electrical contacts to provide an electric switch within the tubular member or may be provided with a light source and light sensor at its opposing ends to configure the safety edge for optical control.

22 Claims, 4 Drawing Sheets

SENSING SAFETY EDGE SYSTEMS

FIELD OF THE INVENTION

The present invention relates to a sensing edge system for a door or the like, which protects persons and other items from injury or damage during door movement.

BACKGROUND OF THE INVENTION

The use of switches or sensing edges attached along the leading edges of movable doors is generally known in the art. Such sensing edges generally include an outer sheath in which an elongated sensing member is positioned. Upon the application of a force to the sheath, the force sensing member actuates suitable control circuitry for controlling the movement of the door, generally stopping or even reversing the closing movement of the door.

Generally, the force-sensing member is a switch which is positioned within the sheath. One construction is disclosed in U.S. Pat. No. 4,396,814 and includes a pair of flexible, electrically conductive sheets positioned on opposite sides of a layer of non-conducting foam having a plurality of openings extending therethrough. Upon the application of an external force to the sheath, for example, from a person or other object trapped beneath the door, the sheets are deflected through the openings in the foam into electrical contact with each other, forming a switch to change the state of circuitry controlling the movement of the door.

Another type of force-sensing switch, which can be positioned within the sheath, is a fluid pressure sensitive switch. One such construction is disclosed in U.S. Pat. No. 4,785,143 and includes a fluid pressure sensitive switch positioned in a rigid, protective structure located in a flexible sheath. The pressure sensitive switch is exposed through a port of the structure with the hollow interior of a hollow, foam rubber tubular-like structure provided within the sheath. Upon application of the force to the sheath, the tubular-like structure within was compressed and the air pressure within the sheath increased, thereby activating the pressure sensitive switch. The switch generated an electrical signal sent to circuitry controlling the movement of the door.

Even earlier pneumatic safety devices were known. U.S. Pat. No. 3,260,812 discloses a safety edge which was formed by two wider and two narrower strips of perforated foam rubber arranged within a square, protective, air-impervious sheath to form a hollow, square tubular body. A fluid coupling was extended from the side of the sheath to an air actuated switch located in the door movement motor circuit. The type of switch, which was available when this earlier pneumatic safety edge was introduced, required a significant amount of air movement from the safety edge for closure. Because of the relative insensitivity of the air actuated switches available at the time, this system required the edge to be of a comparatively large cross-sectional area with respect to the fluid coupling with the air actuated switch, to get the necessary pressure increase. Despite any relative shortcomings it had in comparison with other safety edges employing electrical switches within the sheath, this pneumatically operated safety edge was still desired because the operative mechanism attached to the door was entirely pneumatic and therefore could be used in certain hazardous environments (e.g. explosive environments) where electrical equipment is prohibited or requires extensive spark suppression protection.

SUMMARY OF THE INVENTION

Briefly stated, in a flexible safety edge system mountable to a leading edge of a movable door or the like, the invention is an improvement comprising: an elongated, one-piece extrusion of a flexible and resilient material, the extrusion including an elongated tubular member having an air impervious tubular wall, the extrusion further including a pair of laterally spaced apart support legs extending outwardly from an outer side of the tubular wall, the support legs being spaced apart along an arc of the tubular wall extending over an angle of less than 180°, the extrusion further including an elongated mounting strip extending radially outwardly from the tubular wall along the arc between the pair of support legs and to a greater radial extent than either of the pair of support legs.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
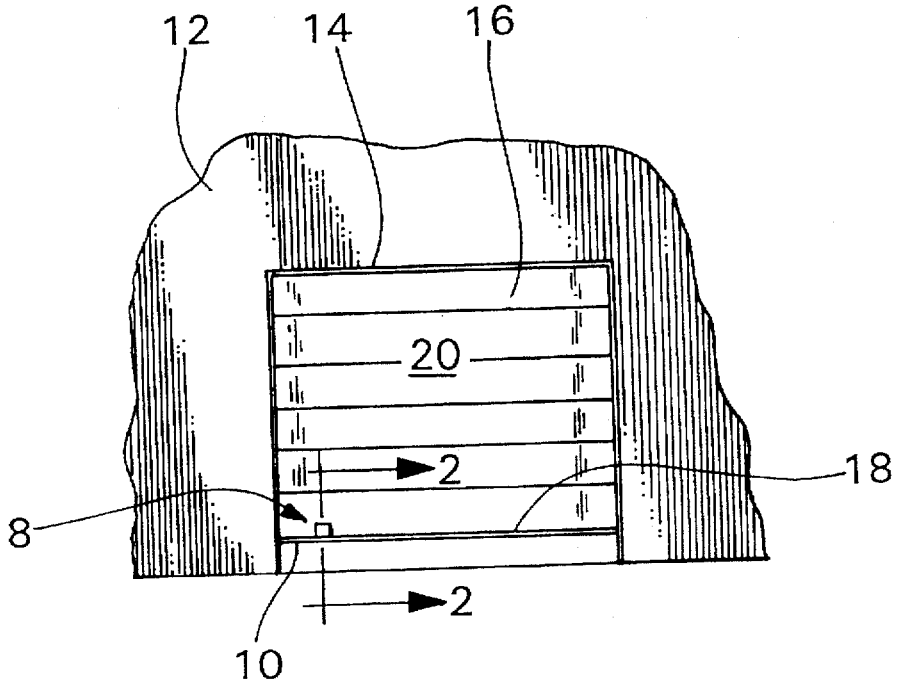
FIG. 1 is an elevation view showing a door construction including the safety edge of the system of the present invention.

Certain terminology is used in the following description for convenience only and is not intended to be limiting. The words "right", "left", "lower" and "upper" designate directions in the drawings to which reference is made. The words "radial" and "axial" refer to directions perpendicular to and along the central axis of an object, element or structure referred to. The words "inwardly" and "outwardly" refer to directions towards and away from, respectively, the geometric center of the object, element or structure. The terminology includes the words above specifically mentioned, derivatives thereof and words of similar import. Moreover, throughout the drawings, like numerals are used to indicate like elements.

Figure 2:
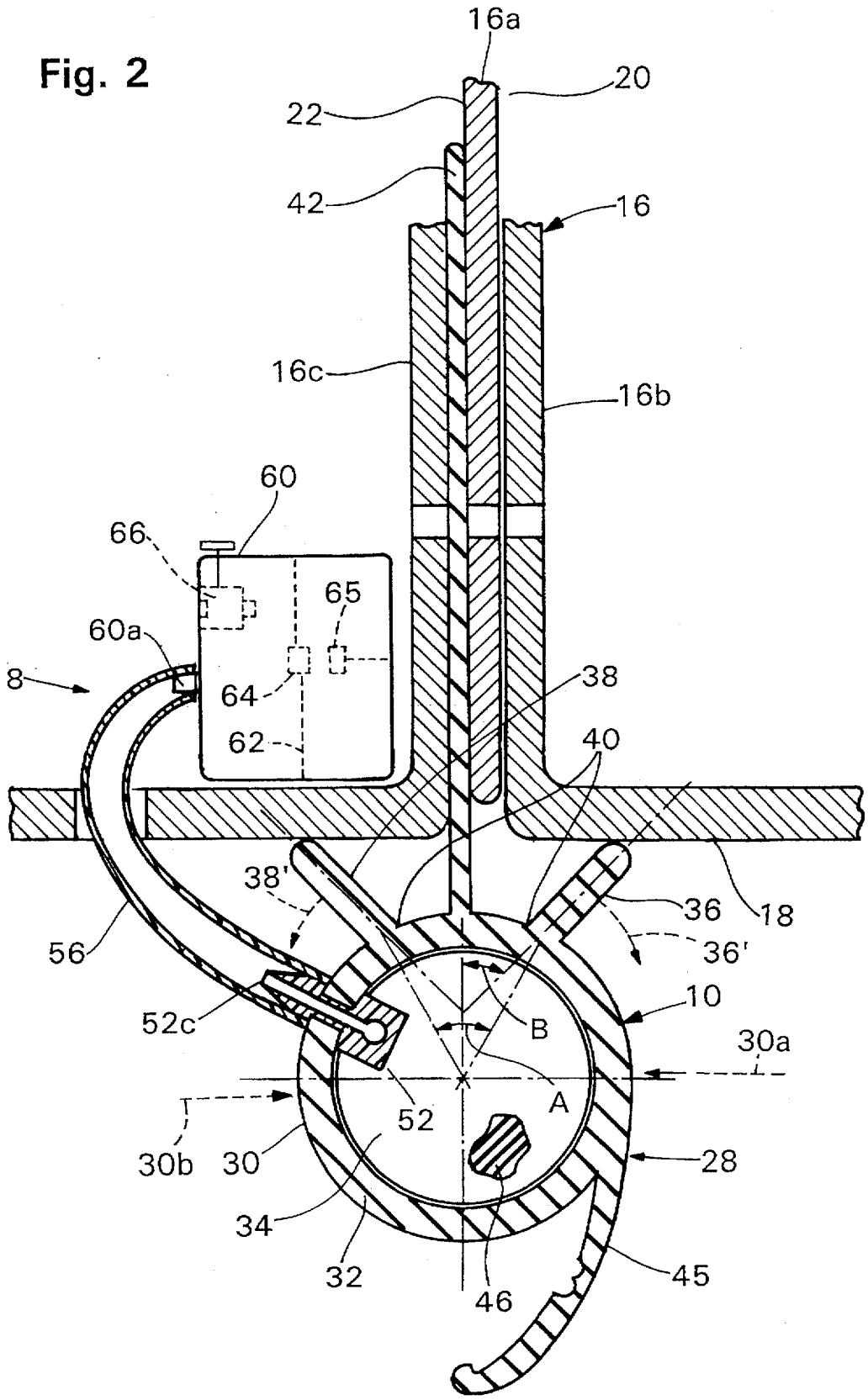
FIG. 2 is a transverse sectional elevation taken generally along the line 2—2 of FIG. 1 and enlarged for clarification.
Figure 3:
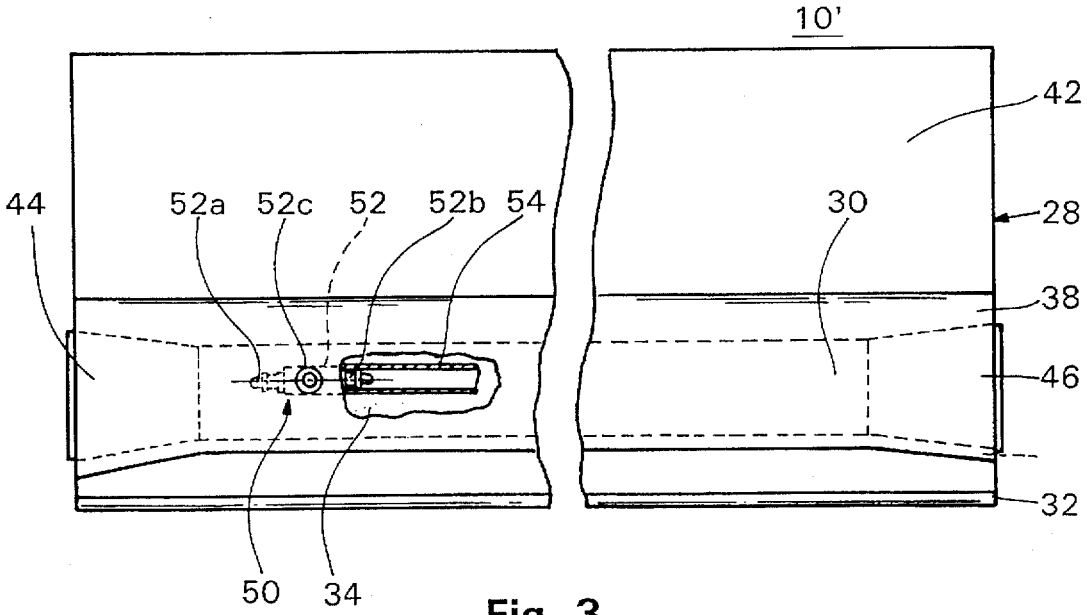
FIG. 3 is a partially broken, side elevation of a sealed sensingle of the system of FIGS. 1–2.

Referring to the drawings, wherein like numerals indicate like elements throughout, there is shown in FIGS. 1–3, a first embodiment of a safety edge system indicated generally at 8 employing a pneumatically operating sensing edge indicated generally at 10. There is shown in FIG. 1, a building wall 12 having a doorway 14 with a partially opened door 16. The pneumatic sensing edge 10 is positioned beneath the door 16 along its leading (i.e., bottom) edge surface 18. While the door 16 is illustrated as an overhead door, it is within the scope and spirit of the invention to incorporate the system 8 with sensing edge 10, hereinafter described, along an edge of any door structure including a horizontally moving door (not shown) as desired. Moreover, it is understood by those of ordinary skill in the art that the system 8 and sensing edge 10 are not limited to use in conjunction with doors, but might be used for other, like applications such as automatically moved windows, skylights, indoor partition walls, etc. The system 8 of the present invention is also particularly useful in explosive environments because the electrical components of the system can be located on an outer side of the door and shielded from a hazardous environment contained by the door. The system 8 and sensing edge 10 are intended for use with automatically closing doors or the like to protect persons, equipment and other objects, including the door itself, from injury or damage by causing the door to automatically stop or open in response to a force being applied to the sensing edge. Circuitry for stopping and/or reversing the movement of automatically closing doors and the like are generally known to those of ordinary skill. They comprise a relay or switch which causes an interrupt or reversal of the current to the door-closing device.

Referring to FIG. 1, the door 16 has, in addition to its leading edge surface 18, first and second major surfaces 20 and 22, which are on opposite sides of the door and vertical when the door 16 is in the closed position. Referring now to FIGS. 2 and 3, the first preferred embodiment of the sensing edge 10 is installed along the lower, leading edge 18 of the door 16. The sensing edge 10 is formed by an elongated, one-piece, extrusion 28 of an air-impervious material. The extrusion 28 includes an elongated tubular member 30 of preferably circular cross sectional shape having an air impervious tubular wall 32. The extrusion 28 further includes a pair of laterally spaced apart support legs 36, 38 which extend the length of the extrusion. The support legs 36, 38 are asymmetrically located on the tubular member 30 so as to be spaced along an arc 40 of the tubular wall 32 having an angle A of less than 180°. The extrusion 28 further includes an elongated mounting strip 42 extending outwardly from the tubular wall 32 along the arc 40 between the pair of support legs 36, 38, and to a greater radial extent than either of the pair of support legs 36, 38. The extrusion 28 further includes an elongated weatherstrip 45 extending tangentially from the tubular wall 32 and preferably wrapping partially around the leading outer side of the tubular member 30 directly opposite the elongated mounting strip 42. The weatherstrip 45 hangs down to cover a small gap, which is desirably provided between the leading edge 18 of the door and the ground or floor within the doorway 14 when the door 16 is fully closed, to prevent damage to the door 16 or the door drive equipment (not depicted) by the door 16 striking the floor or ground. The support legs 36, 38, the mounting strip 42 and the weather strip 45 all extend the length of the tubular member 30.

The support legs 36, 38 are asymmetrically located on the tubular member 30 so as to be spaced apart along an arc of the tubular wall extending over an angle "A" of less than 180 degrees, suggestedly less than 90 degrees and preferably only about 60 degrees. The support legs 36, 38 and the mounting strip 42 are all substantially planar. The planes of the support legs 36, 38 are symmetric with respect to the plane of the mounting strip 42 and each forms an angle "B" of about 60 degrees or less and preferably about 45 degrees with the plane of the mounting strip.

Referring particularly to FIG. 3, closures 44 and 46 are provided in each of the two opposing open ends of the extruded tubular member. 30 and are arranged to seal the opposing ends of the tubular member to air passage. Preferably, each of the closures 44 and 46 is a conically shaped plug. The sensing edge 10 further includes a fluid coupling 50 which is preferably formed by a tubular, T-shaped connector 52 having opposing arms **52*a*, 52*b* and an intermediate transverse arm 52*c*. A length of tubing 54 preferably is mounted on one of the opposing arms 52*b***.

Referring back to FIG. 2, the system 8 further includes a pneumatic or air pressure responsive switch 60, which is located outside of the sensing edge 10 and the tubular member 30. At least one tube 56 fluidly couples the hollow interior 34 of the tubular member sealed with the closures 44 and 46 and the air pressure responsive switch 60. One end of tube 56 is jammed over the end of the transverse arm **52*c* of connector 52 of the fluid coupling 50 exposed on the tubular member 30 while the remaining end of tube 56 is similarly fitted over an air pressure sensing port 60*a*** provided on the switch.

Installation of the system 8 is best explained with respect to FIGS. 2 and 3. The exemplary door 16 depicted in the figures is a conventional steel door including a plurality of connected panels, a bottom one of which is indicated at **16*a*. Along the leading edge 18, first and second angle irons 16*b* and 16*c* are mounted on either of the major opposing surfaces of the panel 16*a*. These are held in place by conventional fasteners such as nuts and bolts (none depicted). The safety edge 10 is preferably first assembled by attaching or installing the fluid coupling 50 and closures 44 and 46 to the tubular member 30 of the extrusion, sealing its hollow interior 34 from air or other fluid passage except through the arm 52*c* of connector 52. One of the angles, for example, 16*c* is removed from the door 16. The elongated mounting strip 42 of the extrusion 28 is positioned against the exposed major surface of the panel 16*a* with one of the support legs 36 butted against the remaining angle 16*b*. The removed angle 16*c* is then replaced while mounting strip 42 is tensioned to assure that the remaining support leg 36 is butted against that angle 16*b* as shown in FIG. 2. Openings are made through the elongated mounting strip 44 at existing fastener openings provided through the angles 16*b*, 16*c* and the panel 16*a*. The fasteners are replaced thereby securing the sensing edge 10 in position along the lower leading edge 18 of the door 16 with both support legs 36, 38 preferably butted against the lower sides of the angles 16*b*, 16*c***, respectively.

At some point during the process, air pressure responsive switch 60 is mounted to the door 16 proximal to the sensing edge 10. Switch 60 might, for example, be mounted to the inner one **16*c* of the angles 16*b*, 16*c*, as depicted, for protection if door 16 is an exterior door. Tube 56 is mounted to arm 52*c* and port 60*a*, thereby fluidly coupling the hollow interior 34 of tubular member 30 of the sensing edge 10 with switch 60. Switch 60 is connected in a desired and conventional fashion with the door advancement circuitry (not depicted) to cause downward movement of the door 16 to at least stop or reverse direction when the tubular member 30 of the edge 10 is collapsed sufficiently to cause switch 60** to change states.

Preferably, each of the arms **52*a*, 52*b* and 52*c* of the T-shaped connector 52 is provided with barbs, serrations or other engagement structures which cause each arm in question to be releasably engaged with the tubular member 30 or tube 56 or length of tubing 54 to prevent the easy separation of each or any of those elements from the T-shaped connector. Preferably, the pair of opposing arms 52*a*, 52*b* together have a maximum linear dimension along those arms which is greater than an inner diameter of the tubular member 30. This is to prevent the arms from being turned into the inner side of the tubular wall 32 in a way in which they are blocked by the tubular wall. The length of tubing 54 is provided as a further precaution to prevent the opposing arms 52***a*, 52*b* of the T-shaped connector 52 from being able to turn very far away from the center line of the tubular member 30.

FIGS. 2–3 depict one possible mounting of connector 52. If desired, the arm 52*c* of the connector 52 can extend elsewhere through the tubular wall 32 of member 30, for example, in the arc 40 extending between the support legs 36 and 38, between one of those legs and the mounting strip 42, where the arm 52*c* is hidden and at least partially protected by the proximal leg 36 or 38.

Figure 4:
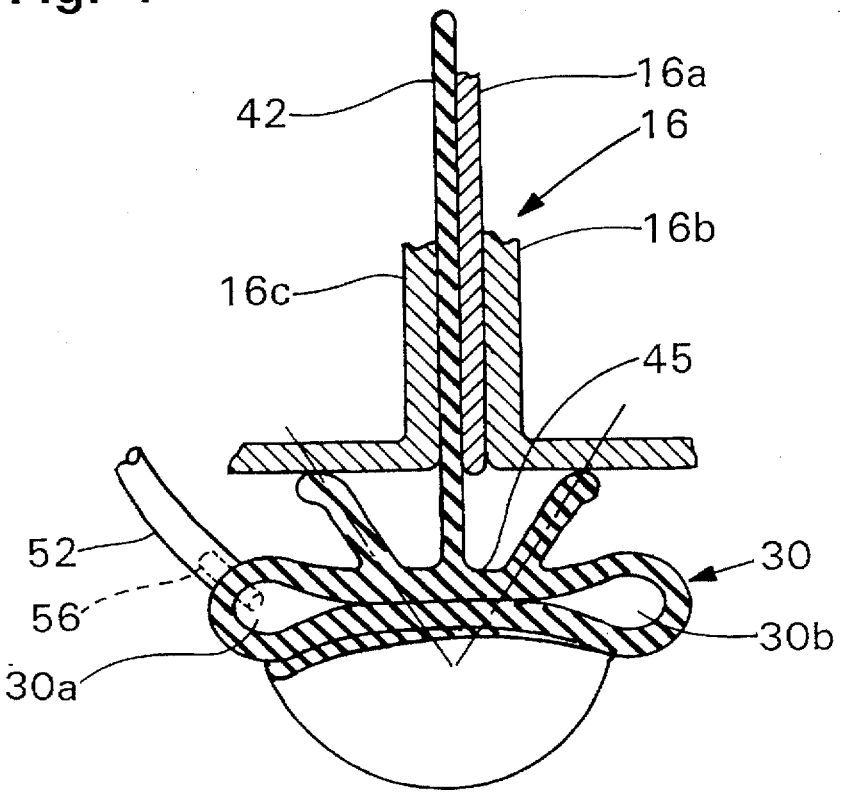
FIG. 4 is a cross sectional view of the sensing of FIGS. 1–3 after being partially collapsed to activate the safety edge system.

FIG. 4 depicts diagrammatically a portion of tubular member 30 between the closures 44, 46, which has been collapsed by contact with some object as might occur when it strikes an object while the door 16 descends. The center of the member 30 between the support legs 36, 38 essentially if not entirely collapses. However, because of the V-shaped orientation of the support legs 36 and 38, the compressive force from the door 16 is directed along the legs 36, 38 to the bottom center of the tubular member 30 causing the member 30 to collapse in the form of "V" as indicated by the broken lines in FIG. 4. At the same time, the lateral sides of the tubular member 30 bulge outwardly and form longitudinal channels 30*a*, 30*b*, which extend the length of the extrusion to the closures 44, 46 at the opposing ends of the member 30. The preferred solid closures 44, 46 tend to prevent full collapse of the ends of the tubular member 30 and provide transverse pneumatic channels extending at the ends of the member 30 between the longitudinal channels 30*a*, 30*b*. The tubular connector 52 is preferably located in one of the lateral sides of the elongated tubular member 30 or close to one of the closures 44, 46 so that the tubular member 30 does not fully collapse around it. In this way, the air pressure responsive switch 60 (see FIG. 2) remains fluidly coupled with the hollow interior of the tubular member 30. The sudden change in internal air pressure in the hollow interior of the tubular member 30 caused by its partial collapse is passed through connector 52 and tube 56 to the switch 60 causing that switch to reverse states and either halt the downward movement of the door 16 or reverse that movement to open the door 16.

When pressure is again removed from the lower side of tubular member 30, the contact forces on the free ends of legs 36, 38, which are created by initially tensioning mounting strip 42 during installation, causes the legs 36, 38 to be bent in downward directions 36' and 38' (phantom in FIG. 2), causing the lateral sides of tubular member 30 to be forced inwardly in directions 30*a*, 30*b* (also in phantom) thereby promoting return of the tubular member 30 to its circular cross-sectional shape.

Figure 5:
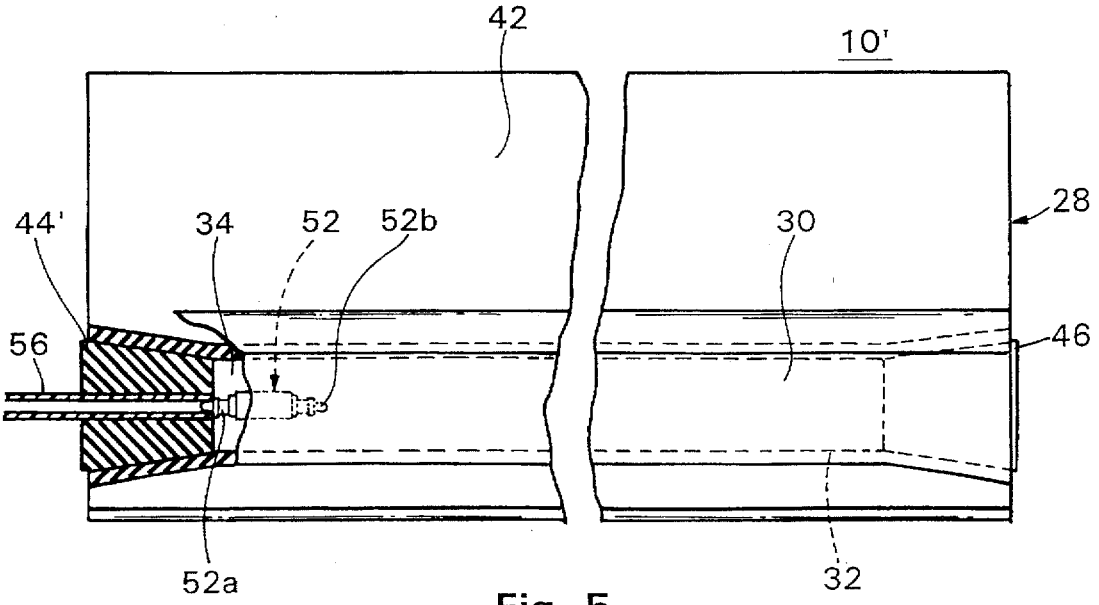
FIG. 5 is a partially broken, side elevation of a second configuration safety edge.

FIG. 5 depicts yet another configuration of a sensing edge of the present invention, indicated generally at 10'. One arm 52*a* of the pair of opposing arms 52*a*, 52*b* of the T-shaped connector 52 is thrust into a bore provided in a plug forming the closure 44' of the sensing edge 10' at one end of the tubular member 30 of extrusion 28. That arm 52*a* is received in an end of the one tube 56 which fluidly couples the hollow interior 34 of the tubular member 30, that is sealed with the closures 44' and 46, and the air pressure responsive switch 60 (see FIG. 2). The barbed end 52*a* of connector 52 is received in and engages with the end of the tube 56, securing it in position in the central bore of the conical plug closure 44' at the one end of the edge 10'. Apart from this difference of connecting the hollow interior 34 of the elongated tubular member 30 with the air pressure responsive switch 60, the sensing edge 10' is identical to the original system 8 and sensing edge 10. Sensing edge 10' can be used on those installations where the fluid coupling tube 56 between the edge 10' and the air pressure responsive switch 60 can be extended around the longitudinal end of the leading edge 18 of the door 16.

The extrusion 28 is formed from an air-impervious, preferably flexible and resilient material. The extrusion 30 suggestedly comprises and preferably consists essentially of neoprene. The closures 44, 44' and 46 are preferably simply commercially available plugs with or without central bore. These can be simply friction engaged with the extrusion 28 by being jammed into the end of the tubular member 30, or can be adhered into place, if desired, for greater security. The plugs can be neoprene but harder material plugs such as nylon or Delrin™, a linear polyoxymethylene-type of acetal resin, can be used if necessary or desired. T-shaped connector 54 is preferably formed of a conventional plastic material harder than neoprene, for example, nylon, Delrin™, or the like.

The air pressure switch 60 can be any suitable pneumatic switch but is preferably an air wave type of pneumatic switch. Such switches typically include a diaphragm 62 carrying an electrical contact 64, a fixed contact 65 and an adjustable bleed valve 66, both of which are pneumatically coupled to the hollow interior of tubular member 30 and are indicated in phantom in FIG. 1. Such switches adjust automatically to slow variations in air pressure caused by atmospheric changes. Valve 66 also permits sudden overpressures to bleed off. They also can be adjusted to be much more sensitive to sudden air pressure changes than were other sealed air pressure responsive switches previously employed, which did not also have a self-adjusting capability. Air wave technology switches may be obtained from a variety of sources including, but not limited to, for example, Fraba GmbH of Köln Germany.

The provision of an extrusion 28 having a tubular member 30 of circular cross-section permits the use of conventional, off the shelf conical plugs 44, 44', 46 as closures. The support legs 36 and 38 further stabilize the extrusion 30 on the door 16, preventing the tubular member 30 from rolling on the bottom of the door 16. As noted earlier, they further tend to pull the vertical sidewall portions of the tubular member back to a more generally vertical orientation when the tubular member 30 has been flattened horizontally, for example, by being compressed too much when the door 16 is closed farther than recommended. This is important because the tubular member 30 has its greatest internal volume and therefore is potentially most sensitive when it is circular in cross section. Without the legs 36, 38, the sidewalls of the tubular member 30 would tend to take a folded set and remain folded for a longer period of time if compressed too much during normal door closure.

Figure 6:
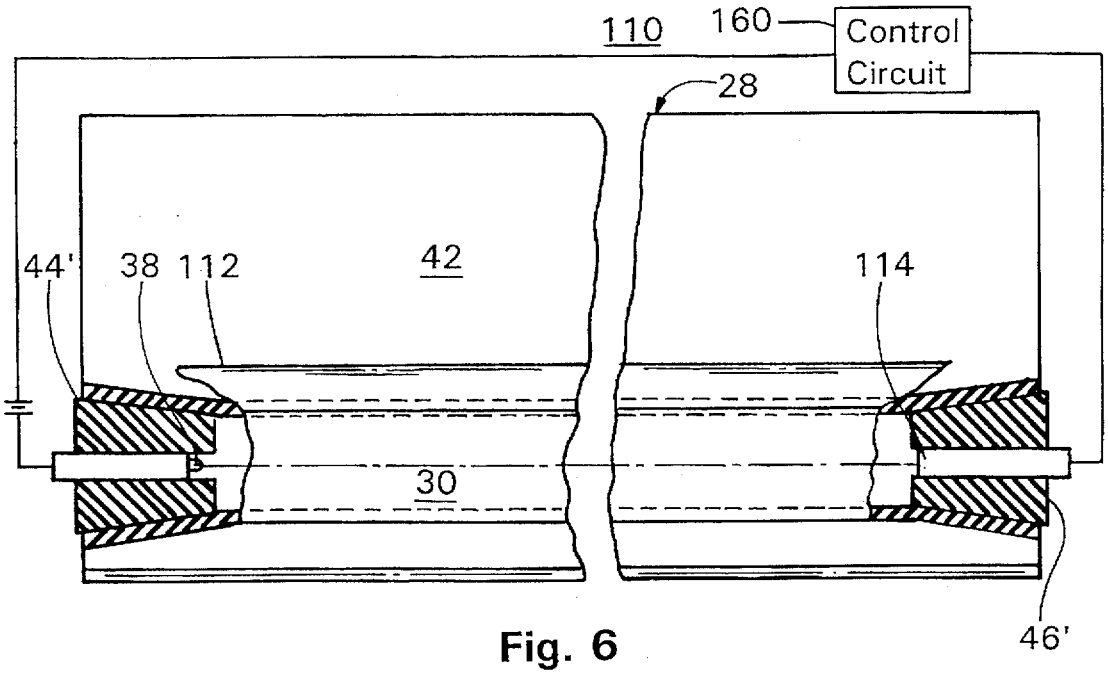
FIG. 6 is a partially broken, side elevation of a third configuration safety edge.

While extrusion 28 has been described being used with a pneumatic switch 60 in sensing edge systems 10, 10', it is equally suited for use with other types of switches. FIG. 6 shows extrusion 28 in another sensing edge system 110 employing a light source 112 in the central bore of one conical plug closure 44' in one end of tubular member 30 and a light responsive photocell 114 in the central bore of another conical plug closure 46' in the opposing end of tubular member 30. Light source 112 and photocell 114 together effectively form an optical switch. Photocell 114 is part of a control circuit 160, which is responsive to a loss of light sensed by photocell 114 and caused by collapse of the tubular member 30 between source 112 and photocell 114, to switch off or reverse a prime mover driving the door or other movable structure mounting the extrusion 28. Light 112 can be powered from circuit 160 as indicated or an independent source.

Figure 7:
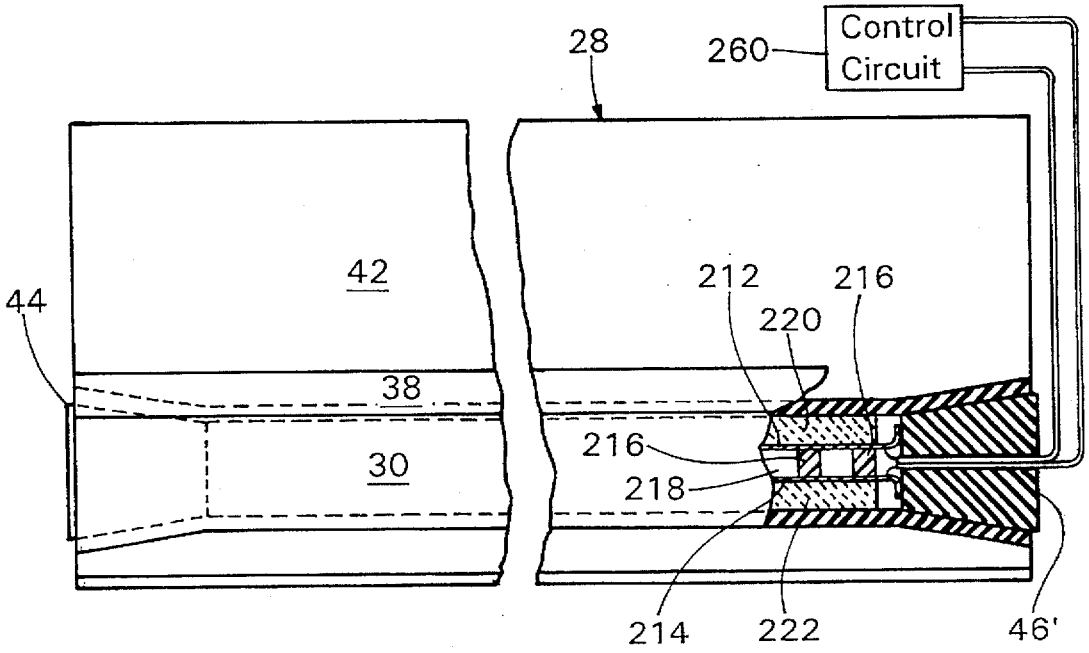
FIG. 7 is a partially broken, side elevation of a fourth configuration safety edge.

Extrusion 28 can also be used with mechanical, momentary contact type switches, which are installed in the hollow interior of tubular member 30. For example, FIG. 7 shows extrusion 28 in yet another sensing edge system 210 employing a first and second electrical conductors 212 and 214, respectively, separated from one another by thin, transversely extending, soft foam rubber spacers 216, which may be cross-members of a ladder-like foam member 218. Additional foam members 220, 222 may be provided on the outer sides of conductors 212, 214, respectively to maintain their positions within tubular member 30. The planes of the contacts 212, 214 should be perpendicular to the plane of the mounting strip 42. Conductors 212, 214 form contacts of a momentary switch that closes when conductors 212, 214 touch each other. The switch forms part of a control circuit 260, which also can be used to switch off or reverses the motion of a prime mover. Any of a variety of existing contacts and holders used in other safety edges might be used in tubular member 30 of extrusion 28.

Also, combination switches (e.g., pneumatic and electric) like or based upon those disclosed in U.S. Pat. Nos. 5,023,411 and 4,396,814, both incorporated by reference herein, might be used.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. In a flexible safety edge system mountable to a leading edge of a movable door or the like, an improvement comprising:

an elongated, one-piece extrusion of a flexible and resilient material, the extrusion including an elongated tubular member having an air impervious tubular wall, the extrusion further including a pair of laterally-spaced apart support legs extending outwardly from an outer side of the tubular wall, the support legs being spaced apart along an arc of the tubular wall extending over an angle of less than 180°, the extrusion further including an elongated mounting strip extending radially outwardly from the tubular wall along the arc of the angle between the pair of support legs and to a greater radial extent than either of the pair of support legs.

2. The improvement of claim 1 wherein the tubular member of the extrusion has a circular shaped cross-section.

3. The improvement of claim 2 further comprising a conical plug closure in each of two opposing open ends of the tubular member.

4. The improvement of claim 1 wherein the mounting strip and support legs are substantially planar and wherein the plane of each support leg forms an angle of about 60° or less with the plane of the mounting member.

5. The improvement of claim 4 wherein the plane of each support leg forms an angle of about 45° with the plane of the mounting strip.

6. The improvement of claim 1 further comprising:

closures in each of two opposing open ends of the tubular member of the extrusion arranged to seal opposing ends of the tubular member to air passage;

an air pressure responsive switch located outside the tubular member; and at least one tube fluidly coupling a hollow interior of the tubular member sealed with the closures and the air pressure responsive switch.

7. The improvement of claim 6 wherein the air pressure responsive switch includes a diaphragm pneumatically coupled with the hollow interior of the tubular member and carrying an electrical contact and further includes an adjustable bleed valve also pneumatically coupled with the hollow interior of the tubular member.

8. The improvement of claim 1 further comprising a light source located in one longitudinal end of the tubular member and a photocell located in an opposing longitudinal end of the tubular member responsive to light from the source so as to form an optical switch within the tubular member.

9. The improvement of claim 1 further comprising a first electrical conductor within the tubular member and a second electrical conductor in the tubular member facing and spaced from the first electrical contact.

10. The improvement of claim 1 wherein the extrusion comprises neoprene.

11. The improvement of claim 1 further comprising a fluid coupling including at least first and second, mutually transverse, fluidly connected arms, the first arm extending transversely through the tubular wall of the tubular member and the second arm being located within the interior of the tubular member, the second arm having an overall length greater than the maximum cross-sectional dimension of an inner diameter of the tubular member.

12. The improvement of claim 11 wherein the fluid coupling comprises a tubular, T-shaped connector having a pair of opposing arms and a maximum linear dimension along the opposing arms greater than the inner diameter of the tubular member.

13. A safety edge system for a movable door or the like comprising:

an elongated, one-piece extrusion of a flexible and resilient, air impervious material, the extrusion including an elongated tubular member having an air impervious tubular wall, the extrusion further including a pair of laterally spaced apart support legs extending outwardly from an outer side of the tubular wall, the support legs being asymmetrically located on the tubular member so as to be spaced apart along an arc of the tubular wall extending over an angle of less than 180°, the extrusion further including an elongated mounting strip extending outwardly from the tubular wall along the arc of the angle between the pair of support legs and to a greater radial extent than either of the pair of support legs;

closures in each of two opposing open ends of the extruded tubular member arranged to seal opposing ends of the tubular member to air passage;

an air pressure responsive switch located outside the tubular member; and at least one tube fluidly coupling a hollow interior of the tubular member sealed by the closures with the air pressure responsive switch.

14. The system of claim 13 wherein the tubular member of the extrusion has a circular shaped cross-section.

15. The system of claim 14 wherein each of the closures comprises a conical plug.

16. The system of claim 13 wherein the mounting strip and support legs are substantially planar and wherein the plane of each support leg forms an angle of about 60° or less with the plane of the mounting member.

17. The system of claim 16 wherein the plane of each support leg forms an angle of about 45° with the plane of the mounting strip.

18. The system of claim 13 wherein the air pressure responsive switch is an air wave technology configured switch.

19. The system of claim 13 wherein the extrusion comprises neoprene.

20. The system of claim 13 wherein the extrusion consists essentially of neoprene.

21. The system of claim 13 further comprising a fluid coupling including at least first and second, mutually transverse, fluidly connected arms, the first arm extending transversely through the tubular wall of the tubular member and the second arm being located within the interior of the tubular member, the second arm having an overall length greater than the maximum cross-sectional dimension of an inner diameter of the tubular member.

22. The system of claim 21 wherein the fluid coupling comprises a tubular, T-shaped connector having a pair of opposing arms and a maximum linear dimension along the opposing arms greater than the inner diameter of the tubular member.

* * * * *